US007236736B2

(12) United States Patent
Konagaya

(10) Patent No.: US 7,236,736 B2
(45) Date of Patent: Jun. 26, 2007

(54) IMAGE RECORDING APPARATUS

(75) Inventor: Tatsuya Konagaya, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 319 days.

(21) Appl. No.: 11/014,851

(22) Filed: Dec. 20, 2004

(65) Prior Publication Data

US 2005/0152724 A1 Jul. 14, 2005

(30) Foreign Application Priority Data

Jan. 9, 2004 (JP) ..... 2004-004647

(51) Int. Cl.
*G03G 15/00* (2006.01)

(52) U.S. Cl. ..... 399/401; 399/395

(58) Field of Classification Search ..... None
See application file for complete search history.

(56) References Cited

U.S. PATENT DOCUMENTS 4,153,241 A * 5/1979 Batchelor et al. ..... 271/4.01
4,978,980 A * 12/1990 Noguchi et al. ..... 347/111
4,979,727 A 12/1990 Koike et al.
5,055,885 A 10/1991 Yoshikado et al.
5,669,031 A * 9/1997 Ishikawa et al. ..... 396/569
6,603,953 B2 * 8/2003 Jewell ..... 399/395
6,782,236 B2 * 8/2004 Sasaki et al. ..... 399/401
6,817,789 B2 * 11/2004 Maruhashi et al. ..... 396/568
6,873,820 B2 * 3/2005 Tanaka et al. ..... 399/395
2001/0014235 A1 * 8/2001 Ando et al. ..... 399/395
2004/0086310 A1 5/2004 Eskey

FOREIGN PATENT DOCUMENTS

EP 0 295 612 A1 12/1988
JP 5-338274 A 12/1993
JP 2003-266803 A 9/2003

* cited by examiner

*Primary Examiner*—Anthony H. Nguyen
(74) *Attorney, Agent, or Firm*—Sughrue Mion, PLLC

(57) ABSTRACT

A printer-processor is provided with a paper feed path that is constituted of a plural number of pairs of conveyer rollers, and a feedback path that branches off the paper feed path to feed a sheet of recording paper back to an upstream position of the paper feed path that is placed before an image recording section. For both-side printing, the paper sheet is first conveyed in a forward direction through the image recording section, to record an image on one side. After being conveyed further in the forward direction along the paper feed path to go past a branching section to the feedback path, the paper sheet is conveyed backward into the feedback path. Thus, the conveying direction through the image recording section is unchanged regardless of which side of the paper sheet is served for the image recording. While the paper sheet is being switched back at the branching section, another paper sheet may be fed into the paper feed path for recording another image thereon through the single image recording section.

8 Claims, 6 Drawing Sheets

IMAGE RECORDING APPARATUS

FIELD OF THE INVENTION

The present invention relates to an image recording apparatus that can record images on opposite sides of a recording material by turning the recording material over to record another image on the other side after recording an image on one side.

BACKGROUND ARTS

Printer-processors can be referred to as one of popular image recording apparatuses, which form a latent image on photosensitive recording paper by exposing it to light beams as modulated in intensity based on digital image data. The digital image data are obtained through photo-electrical scanning of an image recorded on photographic film, or by reading them out of a storage medium like a memory card. The printer-processor also processes the recording paper for development, and then dries the paper to produce a photo print. The advantage of such a digital printer-processor is that it can process image data to correct color balance and sharpness, so as to improve the image quality of the photo print.

In the field of the image recording apparatus, many technologies for recording images on opposite sides of recording paper have recently been disclosed, in order to be adaptable to user's needs for diversity and efficient use of recording paper.

Japanese Laid-open Patent Application Hei 5-338274 discloses a both-side printing method which uses a recording device and a turnover device for turning the recording paper in a loop. An image is recorded on one side of the recording paper as it is conveyed in a forward direction. After turning the recording paper over through the turnover device, another image is recorded on the other side as the recording paper is moved in an opposite direction.

Japanese Laid-open Patent Application 2003-266803 discloses a both-side printing method which uses two recording devices and a turnover device placed between these recording devices. An image is recorded on one side of the recording paper by the first recording device. After turning the recording paper over through the turnover device, another image is recorded on the other side by the second recording device.

According to the former prior art, since the recording paper is moved in opposite directions during the printing, it is necessary to convey the recording paper with high accuracy in both directions, in order to record images properly. The demand for high accuracy in paper-transportation will raise the cost. Moreover, because this method does not allow printing on the next sheet of recording paper so long as the foregoing sheet is subjected to the both-side printing, it is hard to improve the processing efficiency.

On the other hand, because the recording device of the digital printer uses a laser exposure unit, and the laser exposure unit is fairly expensive, using two recording devices, like in the latter prior art, is not preferable in terms of cost.

Moreover, in the latter prior art, since the two recording devices are arranged side by side along a paper passageway, the printer for this method must be pretty large in scale.

SUMMARY OF THE INVENTION

In view of the foregoing, an object of the present invention is to provide an image recording apparatus that is small in size, inexpensive, and performs both-side printing with high efficiency.

According to the present invention, an image recording apparatus that supplies a sheet of recording material of a predetermined length from a supply section and conveys the recording material along a feed path from the supply section through an image recording section to an ejecting section, to record an image on the recording material in the image recording section, the image recording apparatus comprising:

a feedback path for feeding the recording material from a section of the feed path between the image recording section and the ejecting section back to a section of the feed path between the supply section and the image recording section;

a first guide member disposed between the image recording section and the ejecting section, the first guide member being switched over between a first position for guiding the recording material from the image recording section to the ejecting section and a second position for guiding the recording material from a side of the ejecting section to the feedback path; and a controller that switches the first guide member to the second position after the recording material goes past the first guide member in the first position, and then conveys the recording material in opposite direction to feed the recording material into the feedback path, thereby to feed the recording material in its reversed position again through the image recording section, for recording images on both sides of the recording material.

According to a preferred embodiment, the image recording apparatus is provided with a buffer section that is branched from the feed path between the first guide member and the ejecting section. The buffer section holds the recording material temporarily. A second guide member is switched over between a first position for guiding the recording material from the first guide member toward the ejecting section and a second position for guiding the recording material from the first guide member toward the buffer section. The controller feeds the recording material through the second guide member in its second position into the buffer section with one end of the recording material ahead, and after an opposite end of the recording material goes past the first guide member in its first position, the controller switches over the first guide member to its second position, and then conveys the recording material in opposite direction to feed the recording material into the feedback path.

According to another preferred embodiment, the image recording apparatus further comprises a backside imprint section between the first and second guide members, wherein, when one-side printing is designated, the backside imprint section imprints information on a back side of the recording material after the recording material has an image recorded on another side and goes past the first guide member in its first position, and the controller feeds the recording material, after having information imprinted on the back side, toward the ejecting section through the second guide member in its first position.

It is possible to feed a second sheet of recording material to the image recording section for recording a different image on the next sheet while a first sheet of recording material is being fed to a section of the feed path behind the first guide member, or to the feedback path for the sake of both-side printing. Therefore, the efficiency of printing is improved.

BRIEF DESCRIPTION OF THE DRAWINGS

The above and other objects and advantages will become more apparent from the detailed description of the preferred embodiments when read in connection with the accompanying drawings, wherein like reference numerals designate like or equivalent parts throughout the several views, wherein.

DETAILED DESCRIPTION OF THE PREFERRED EMBODIMENTS

Figure 1:
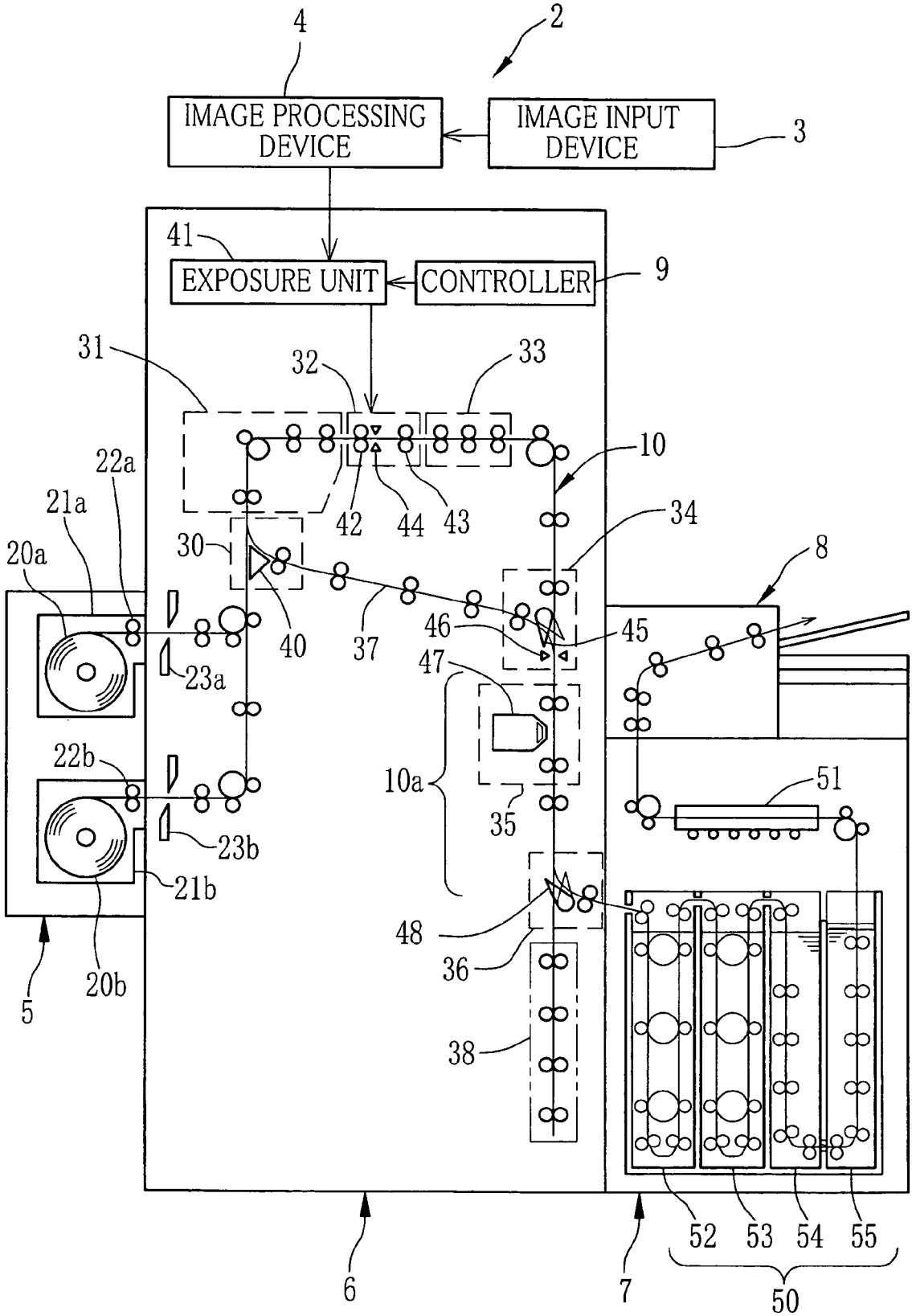
FIG. 1 is a schematic diagram of a printer-processor according to an embodiment of the present invention.

The printer-processor 2 shown in FIG. 1 is provided with an image input device, an image processing device 4, a paper supply section 5, a printer section 6, a processor section 7 and a paper ejecting section 8. These parts of the printer-processor 2 connected to a controller 9 through not-shown wiring, so the controller 9 controls the overall operation of the printer-processor 2. A number of pairs of feed rollers are disposed to feed cut-sheets of paper P through a paper passageway 10 from the paper supply section 5, the printer section 6, the processor section 7 to the paper ejecting section 8.

The image input device 3 produces image data by reading an optical image through a photoelectric imaging device, like a CCD image sensor, wherein the optical image is formed by illuminating an image recorded on photographic film. The image input device 3 also obtains image data by reading it out from an external storage device, like a memory card. The image data is sent to the image processing device 4, which processes the image data for color balance correction, density correction, and other predetermined image processing. The processed image data is sent to the printer section 6, for use in an exposure recording as set forth later.

The paper supply section 5 is loaded with magazines 21*a* and 21*b*, each of which contains a roll of long web of photosensitive recording paper 20*a* or 20*b*. The magazines 21*a* and 21*b* are provided with pull-out roller pairs 22*a* and 22*b* for pulling the photosensitive recording paper 20*a* and 20*b* out of the rolls in the magazine 21*a* or 21*b* respectively.

The magazine 21*a* is served for both-side print. The photosensitive recording paper 20*a* contained in this magazine 21*a* is a photosensitive material with photographic emulsion layers on opposite sides of a base material whose light-permeability is low so that an exposure of one side will not affect the other side. The magazine 21*b* is served for one-side print. The photosensitive recording paper 20*b* contained in this magazine 21*b* is a photosensitive material with an emulsion layer on one side. The magazines loaded in the printer-processor 2 may not be limited to the above magazines 21*a* and 21*b*. It is possible to use a magazine or more than two magazines. For example, magazines may be provided for different print sizes, such as a magazine for L-size print containing 89 mm-wide paper and a magazine for 2L-size print containing 127 mm-wide paper. It is also possible to load the same kind magazines as reserve stocks.

Cutters 23*a* and 23*b* are disposed in a variable distance from exits of the magazines 21*a* and 21*b*, for cutting the photosensitive papers 20*a* and 20*b* respectively. The cutters 23*a* and 23*b* are each driven in response to a control signal from the controller 9, to cut the photosensitive paper 20*a* or 20*b* into a cut-sheet paper P of a predetermined size. The distance of the cutter from the exit of the magazine is determined individually by the size of the paper sheet P assigned thereto.

It is alternatively possible to load the paper supply section 5 with cut-sheet papers of predetermined sizes, without providing the cutters 23*a* and 23*b*. The cutter is not to be limited to the two-edge type like in the illustrated embodiment, but any conventional types, such as a rotary cutter, may be applicable.

The printer section 6 records a latent image on the photosensitive paper sheet P by exposing it to light beams while the paper sheet P is being conveyed. The light beams are modulated in intensity based on digital image data. The printer section 6 is provided with a feedback receipting section 30, a registering section 31, an image recording section 32, a sub-scan supporting section 33, a feedback branching section 34, a backside imprint section 35, and an exit branching section 36, wherein a feedback path 37 is provided for feeding the paper from the feedback branching section 34 to the feedback receipting section 30.

The feedback receipting section 30 is provided with a wedge-shaped guide 40 for guiding the paper sheets P from the paper supply section 5 and ones fed back through the feedback path 37 toward the registering section 31. The registering section 31 corrects skews of the paper sheets P so as to align a leading edge of the individual cut-sheet with a main scan direction of the image recording section 32, thereby to prevent failure in registering the exposure position and angle, wherein the main scan direction is transversal or perpendicular to a paper conveying direction.

FIGS. 2A to 2D show the registering section 31. The registering section 31 is served for so-called tilt-registering. The registering section 31 consists of two pairs of registering rollers 60 and 61, two pairs of conveyer rollers 62 and 63 disposed before and behind the registering roller pairs 60 and 61, and two registering sensors 64*a* and 64*b* disposed between the registering roller pairs 60 and 61. The registering roller pairs 60 and 61 are used for adjusting the inclination of the paper sheet P and its lateral position. The registering sensors 64*a* and 64*b* detect the paper sheet P going past them. The registering rollers 60 and 61 are movable in the main scan direction for the sake of adjusting the lateral position of the paper sheet P, and is also rotatable about an axis that crosses a point Z perpendicularly to the paper surface. As the way to move and rotate these rollers 60 and 61, any one of suitable conventional methods is usable. As an embodiment of the registering sensor 64*a* or 64*b*, an optical sensor consisting of a light emitting element and a light receiving element is usable. Because the conveying speed of the paper sheet P by the conveyer rollers 62 and 63, as well as the spacing between the registering sensors 64*a* and 64*b* are known, it is possible to detect the skew of the paper sheet P based on a difference in detection time of the leading edge of the paper sheet P between the registering sensor 64*a* and the other registering sensor 64*b* that is located on the same line as the registering sensor 64*a* in the main scan direction.

Figure 2A:
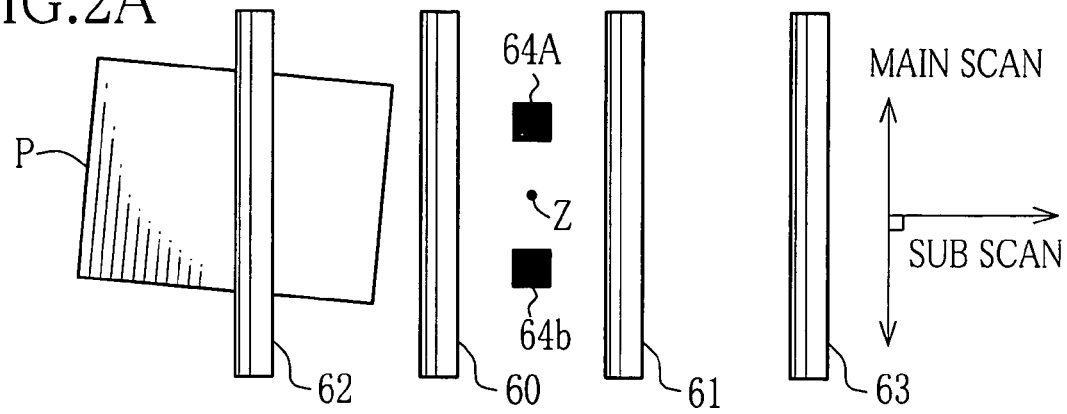
FIGS. 2A, 2B, 2C and 2D are explanatory views schematically illustrating a method of correcting skews by a tilt-resist device.
Figure 2B:
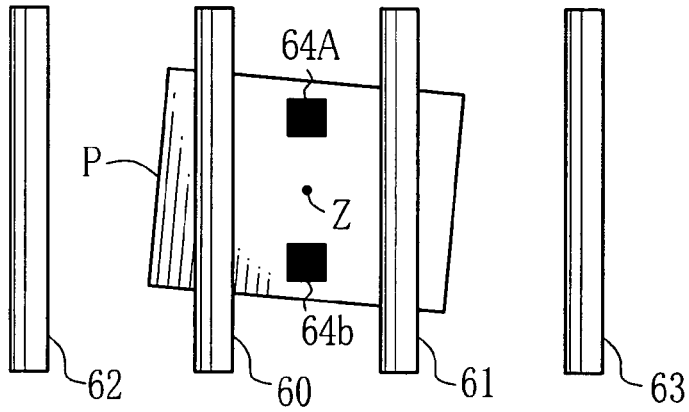
Figure 2C:
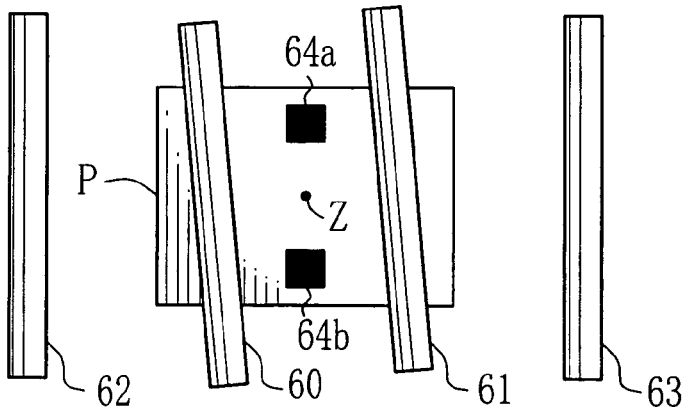
Figure 2D:
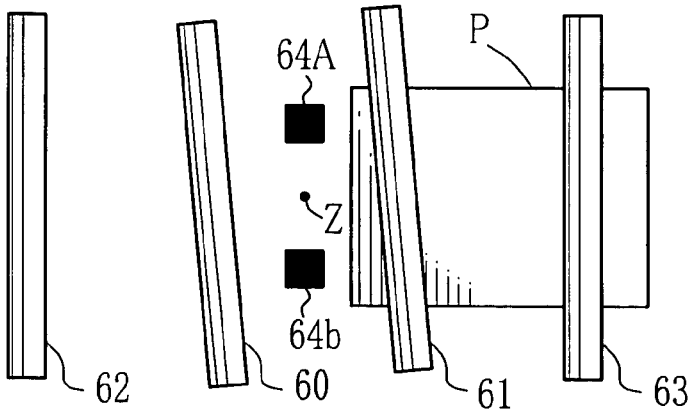

As shown in FIG. 2C, the skew correction is carried out by turning the registering rollers 60 and 61 in accordance with the inclination detected by the registering sensors 64*a* and 64*b*.

However, the way of correcting the skew is not to be limited to the above described method. For example, a top registering method, a side registering method or another conventional method is applicable. The top registering method is to bring a leading edge of the paper sheet P into contact with a pair of conveyer rollers in their nipping position, to make the paper sheet P sag to correct the skew. The side registering method is to bring a lateral side edge of the paper sheet P into contact with a guide member to correct the skew.

The image recording section 32 is constituted of an exposure unit 41, two pairs of sub scan rollers 42 and 43, and a paper sensor 44 that detects the paper sheet P when it passes by the sensor 44. The exposure unit 41 is connected to the image processing device 4, and sweeps red, green and blue light beams across the paper sheet P in the main scan direction when the paper sensor 44 detects the leading edge of the paper sheet P. The light beams are modulated in intensity on the basis of the image data from the image processing device 4, so a full-color image is recorded on the paper sheet P. The sub scan roller pairs 42 and 43 are placed respectively before and behind a position exposed to the light beams with respect to the paper conveying direction. The sub scan roller pairs 42 and 43 convey the paper sheet P at a given speed in a sub scan direction that is parallel to the proper paper conveying direction.

The sub scan roller pairs 42 and 43 have nip rollers, each of which is movable between a nipping position to nip the paper sheet P and a position away from the paper sheet P. The position of the nip rollers is switched over when a not-shown position sensor detects the leading edge or a trailing edge of the paper sheet P. Thereby, the paper sheet P is prevented from getting shocked too much as its leading edge runs against the downstream sub scan roller pair 43, and as its trailing edge gets out of the upstream sub scan roller pair 42. Otherwise, the impact on the paper sheet P will disturb the image recorded on the paper sheet P.

The sub-scan supporting section 33 is provided with a number of pairs of rollers, which hold the leading end of the paper sheet P as it is moved out of the image recording section 32 during the image recording, to convey the paper sheet Pin the forward direction at the same speed as it is conveyed through the image recording section 32. Each conveyer roller pair consists of a drive roller and a nip roller, and does not nip the paper sheet P during the exposure to the light beams. When the exposure recording is finished to the trailing end of the paper sheet P, the nip rollers move to nip the paper sheet P. Thereby, the leading edge of the paper sheet P will not run against the conveyer rollers of the sub-scan supporting section 33, so the conveying speed is not affected by these rollers.

The feedback branching section 34 is provided with a switching guide 45 and a paper sensor 46. The switching guide 45 switches over between a first position to guide the paper sheet P to the backside imprint section 35 and a second position to guide the paper sheet P to the feedback path 37. The switching guide 45 is connected to an electric motor or the like, and is driven by the motor to move between the first and second positions under the control of the controller 9. The paper sensor 46 detects that the trailing end of the paper sheet P goes out of the feedback branching section 34. A usable example of the paper sensor 46 is an optical sensor consisting of a light emitting element and a light receiving element.

The backside imprint section 35 is provided with a backside printing head 47 to print various information on the back side of the paper sheet P if it is used for printing an image on the obverse side only. The information printed on the back side includes date of photograph, date of printing, frame number, ID number and so on. The backside printing head 47 may be any conventional printing head, such as a dot-impact head, an ink-jet head, a thermal transfer printing head, insofar as the printed information will last through a wet developing process which the paper sheet P is subjected to afterward.

The exit branching section 36 is provided with a switching guide 48 that switches over between a first position to guide the paper sheet P to the processor 7, and a second position to guide the paper sheet P to a switch back buffer 38 that holds the paper sheet P temporarily while the paper sheet P is being switched back. The switching guide 48 is connected to an electric motor or the like, and is driven by the motor to move between the first and second positions under the control of the controller 9.

Within the paper feed path 10, the paper sheet P is conveyed backward, i.e. in reverse to the direction from the paper supply section 5 to the paper ejecting section 8, in a section 10a between the switching guides 45 and 48. Also in the switch back buffer 38, the paper sheet P is conveyed forward, i.e. toward a distal end of the switch back buffer 38, and backward, i.e. toward the switching guide 48.

It is possible to permit conveying the paper sheet P in the backward direction throughout the paper feed path 10. But that is not preferable for the sake of processing a number of recording paper sheets P simultaneously. Accordingly, it is preferable to permit conveying the paper sheet P in the backward direction only in the section 10*a* between the feedback branching section 34 and the exit branching section 36. In the feedback path 37, the paper sheet P is conveyed only in one direction from the feedback branching section 34 to the feed back receiving section 30.

The processor section 7 consists of a developing section 50 and a drying section 51. The developing section 50 is provided with a developing tank 52, a bleaching tank 53, a first wash tank 54, and a second wash tank 55, which are placed in this order in the forward direction. The developing tank 53 holds a developing solution, the bleaching tank 53 holds a bleach-fix bath, and the first and second wash tank 54 and 55 hold washing water. After being recorded with a latent image, the paper sheet P is conveyed sequentially through the respective tanks 52 to 55, to develop and fix the image and wash the paper.

The drying section 51 is placed above the processing tanks 52 to 55, and consists of a conveyer belt and an air duct. From the air duct toward the conveyer belt, heated drying air is blown out to push the paper sheet P on the conveyer belt. As the paper sheet P is conveyed through the air duct in this condition, the washing water remaining on the paper sheet P is taken away. The paper ejecting section 8 ejects a number of paper sheets P, after being processed and dried, in the unit of each printing job.

Now the operation of the printer-processor 2 will be described with reference to FIGS. 3 to 5.

Figure 3B:
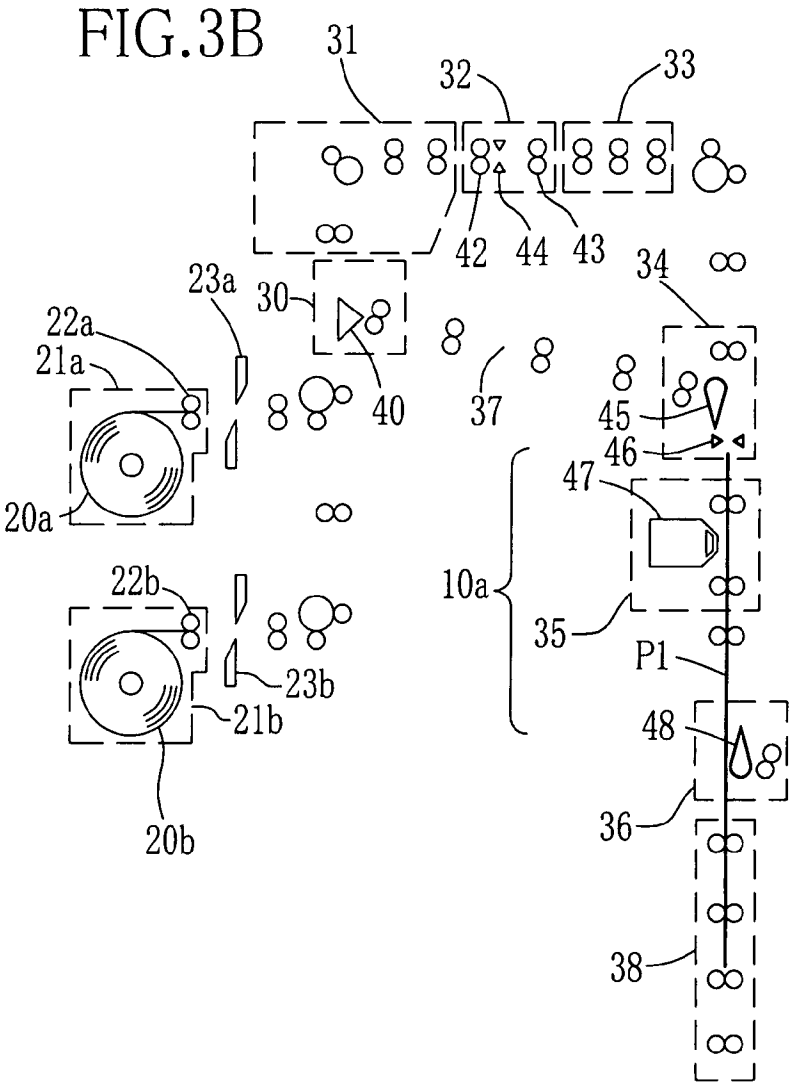
FIGS. 3A and 3B are explanatory views schematically illustrating a flow of a paper sheet for the both-side printing.
Figure 3A:
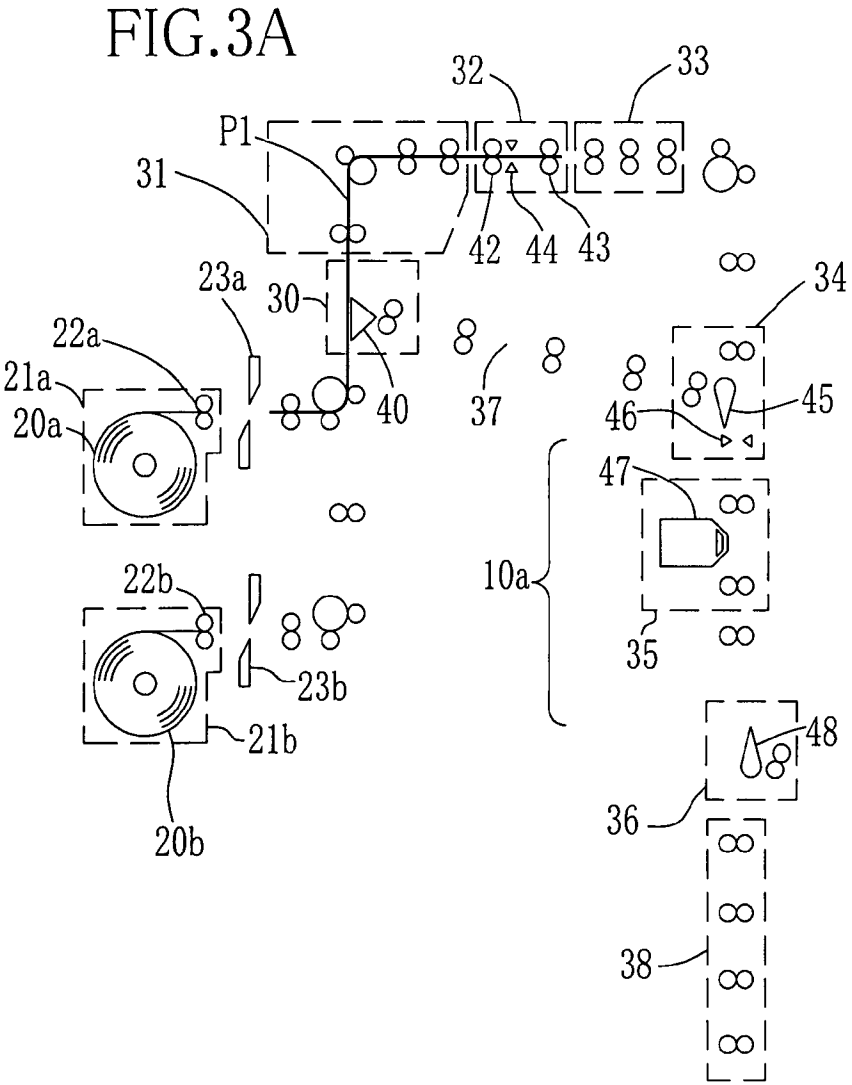

As shown in FIG. 3A, upon receipt of a print command, the controller 9 pulls the photosensitive recording paper 20*a* a given length out of the magazine 21*a* in the paper supply section 5, and drives the cutter 23*a* to form a first paper sheet P1. The first paper sheet P1 is conveyed through the paper feed path 10 to the registering section 31, to correct its skew.

After the skew being corrected by the registering section 31, the paper sheet P1 is conveyed to the image recording section 32, where an image is recorded on one side of the paper sheet P1 by sweeping light beams across the paper sheet P, the light beams are modulated in intensity on the basis of image data from the image processing device 4. After the image being recorded on one side, the paper sheet P1 is sent to the feedback branching section 34 through the sub-scan supporting section 33. And, as shown in FIG. 3B, the paper sheet P1 is guided through the paper feed path section 10*a* to the switch back buffer 38, as the switching guide 45 of the feedback branching section 34 is set to the first position, and the switching guide 48 of the exit branching section 36 is set to the second position. If the paper sheet P1 is pretty long, the most length of the paper sheet P1 is sent into the switch back buffer 38, thereby preventing the paper sheet P1 from going into the processor section 7 before another image is recorded on its back side.

Figure 4B:
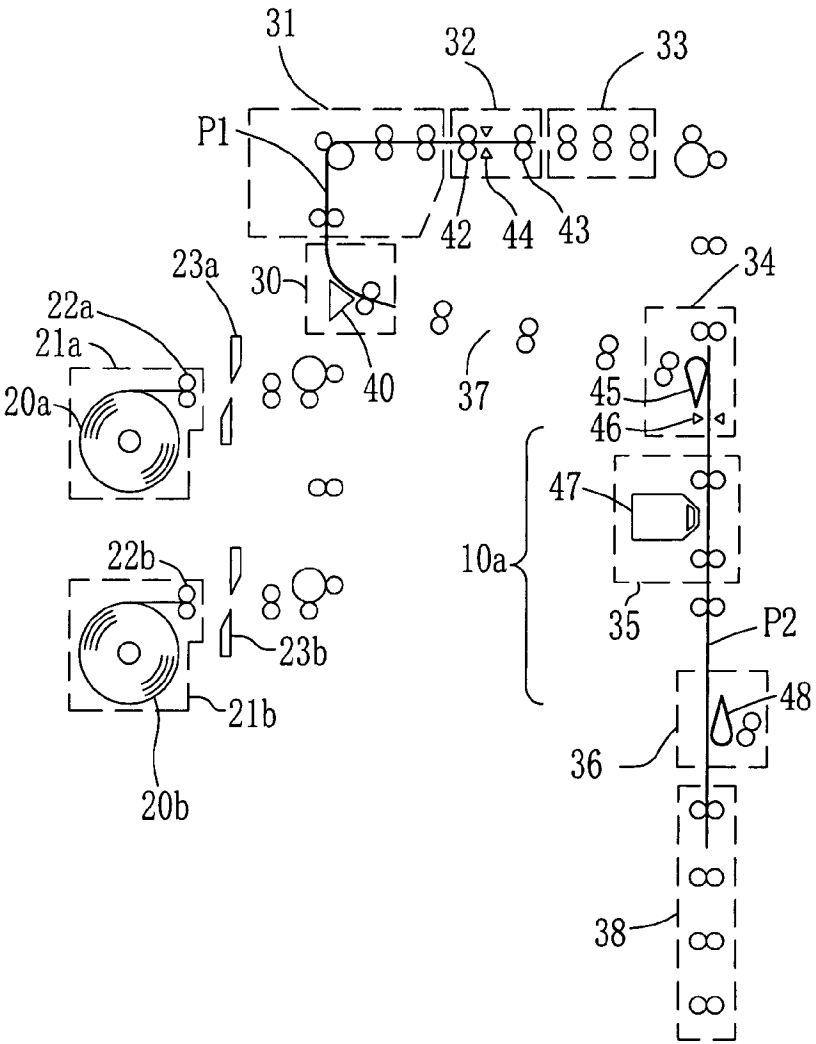
FIGS. 4A and 4B are explanatory views schematically illustrating the flow of the paper sheet for the both-side printing, continued from the flow shown in FIGS. 3A and 3B.
Figure 4A:
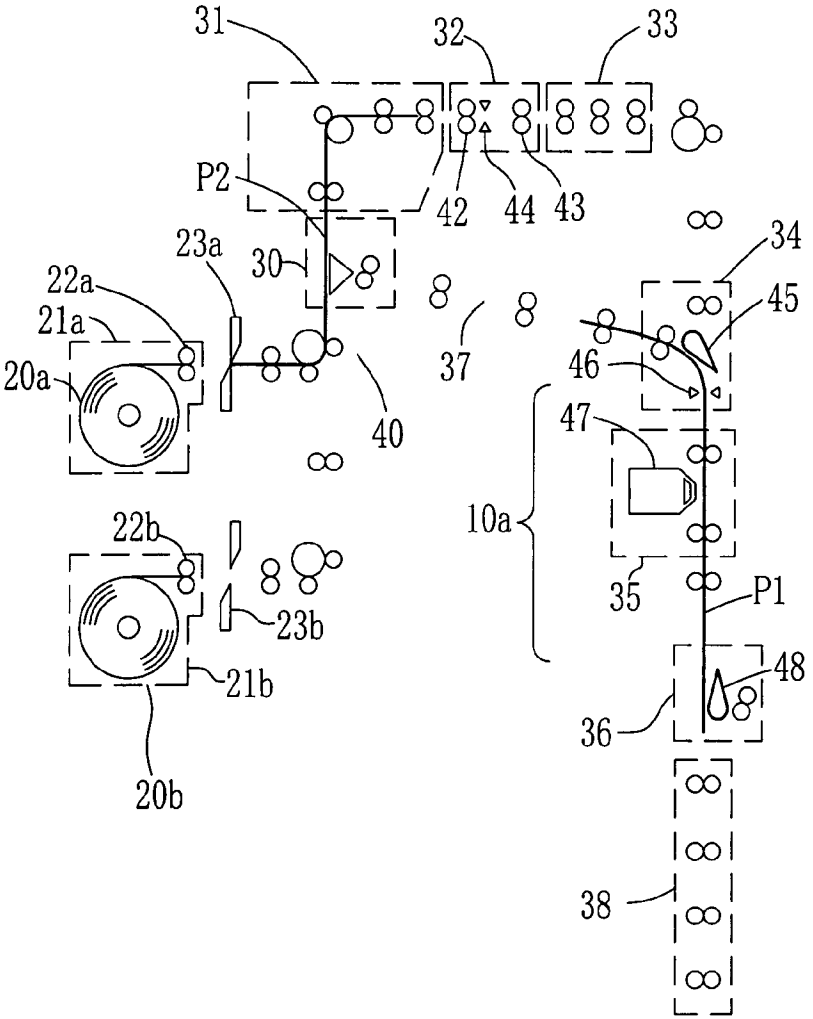

When the paper sensor 46 detects that the trailing edge of the paper sheet P1 goes past the feedback branching section 34, the switching guide 45 of the feedback branching section 34 is switched to the second position, as shown in FIG. 4A, so that the paper sheet P1 is guided into the feedback path 37 as it is conveyed in the backward direction. During these serial operations, a second paper sheet P2 is fed out from the magazine 21*a* through the registering section 31 to the image recording section 32. After an image is recorded on the paper sheet P2 in the image recording section 32, the second paper sheet P2 is further conveyed forward.

When the whole length of the first paper sheet P1 is located in the feedback path 37, that is, in a predetermined time after the paper sensor 46 detects that the leading edge P1 of the paper sheet P1 goes past it, the switching guide 45 is switched to the first position.

The first paper sheet P1, after being reversed through the feedback path 37, is fed back into the paper feed path 10 by the wedge-shaped guide 40, and is conveyed through the registering section 31 again. Thereafter, the first paper sheet P1 is conveyed through the image recording section 32, as shown in FIG. 4B, to record another latent image on the back side. Thus, the images are recorded on both sides of the paper sheet P1. Since the paper sheet P1 is corrected its lateral position and skew before the image is recorded on the back side, the image is printed on either side without being failed in registering. While the image is being recorded on the back side of the first paper sheet P1, the second paper sheet P2 is fed to the switch back buffer 38, to be fed back through the feedback path 37 in the same way as for the first paper sheet P1.

Figure 5B:
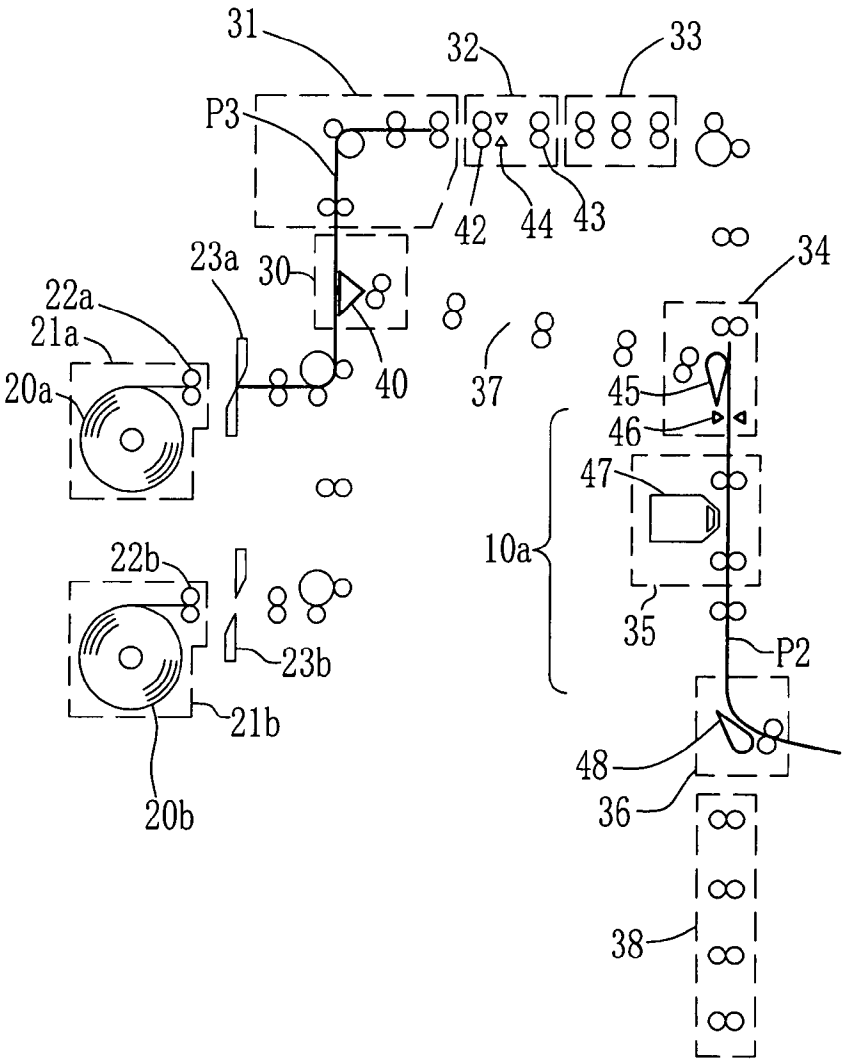
FIGS. 5A and 5B are explanatory views schematically illustrating the flow of the paper sheet for the both-side printing, continued from the flow shown in FIGS. 3A and 3B.
Figure 5A:
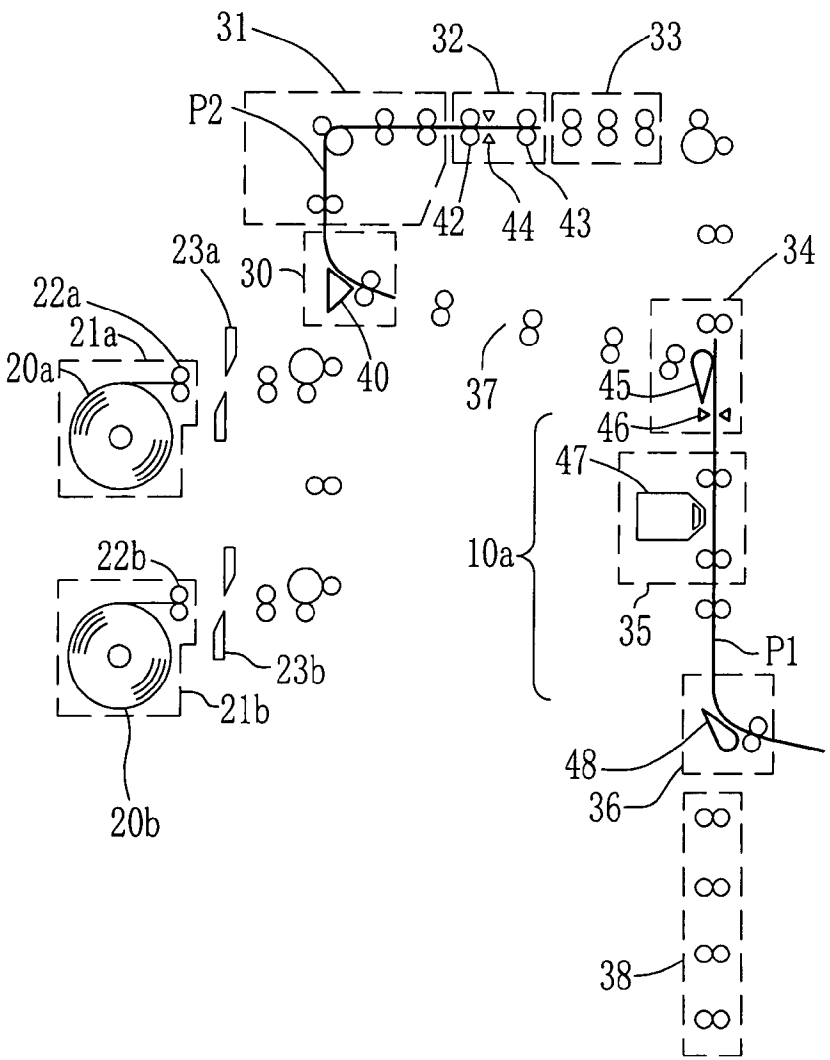

The first paper sheet P1 having the images on both sides is guided by the switching guide 48 to the processor section 7, as the switching guide 48 is set to the first position, as shown in FIG. 5A. Meanwhile, an image is recorded on the back side of the second paper sheet P2.

As shown in FIG. 5B, the second paper sheet P2 having the images recorded on opposite sides is conveyed to the processor section 7 in the same way as for the first paper sheet P1. At the same time, a third paper sheet P3 is fed out of the magazine 21*a*, and is subjected to the same processes as shown sequentially in FIGS. 3 to 5.

In a case of one-side printing, a paper sheet P is fed out of the magazine 21*b*, and is subjected to the same processes in the registering section 31 and the image recording section 32. Thereafter, the paper sheet P is conveyed to the feedback branching section 34, where the paper sheet P is guided to the paper feed path section 10*a* by the switching guide 45 in the first position. According to the need, designated information is imprinted by the backside imprint section 35. Then the paper sheet P is guided to the processor section 7 by the switching guide 48 that is set in the first position.

In the one-side printing, if the length of the paper sheet P along the paper feed path is more than a distance between the image recording section 32 and the backside imprint section 35, the impact on the paper sheet P by the backside imprint section 35 or the like can badly affect the image recording in the image recording section 32. But it is undesirable to elongate the distance between the image recording section 32 and the backside imprint section 35 enough for the length of the paper sheet P, because this solution will lead to enlarging the whole scale of the apparatus.

To solve this problem, if the length of the paper sheet P along the paper feed path is greater than the distance between the image recording section 32 and the backside imprint section 35, the switching guide 48 is switched to the second position to guide the paper sheet P once into the switch back buffer 38 without making the backside imprinting. Thereafter when the trailing edge of the paper sheet P comes to the backside imprint section 35, the backside imprint section 35 is activated to imprint the information on the back side of the paper sheet P while it is being conveyed in the backward direction. After the backside imprinting is finished, the paper sheet P is conveyed again in the forward direction to the processor section 7. Thus, the distance between the image recording section 32 and the backside imprint section 35 can be minimized. It is alternatively possible to convey the paper sheet P backward till the trailing edge of the paper sheet P in this direction goes past the backside imprint section 35, and then make the backside imprinting while conveying the paper sheet P forward. In either case, the apparatus must be able to convey the paper in the backward direction not only in the paper feed path section 10*a* but also in a section between the magazine 21*b* and the feedback branching section 34.

Although the paper feed path in the switch back buffer 38 is illustrated as a linear section, it is preferable to configure the switch back buffer 38 to have a curved or waved paper feed path, so as efficiently to use dead space in the printer-processor 2.

The processor section 7 produces a photo print by processing the individual paper sheet P, including the paper sheets P1 and P2, for development, fixing and washing. After being dried through the drying section 51, the photo print is sent to the ejecting section. The ejecting section 8 ejects the photo prints out of the printer-processor 2 in groups which are sorted according to the printing job assigned to these photo prints.

In the above embodiment, if the distance between the magazine 21*a* and the image recording section 32 is less than a maximum length of the paper sheet P along the paper feed path, that is about 460 mm, it badly affects the conveying speed of the sub-scan roller pairs 42 and 43, causing white or black streaks as well known in the art. On the contrary, making the distance between the magazine 21*a* and the image recording section 32 large enough for the maximum length of the paper sheet P results in enlarging the apparatus undesirably.

As a solution for this problem, the photosensitive recording paper 20*a* is first fed to the vicinity of the image recording section 32 before the cutter 23*a* is driven to cut the paper 20*a* into the paper sheet P, wherein the distance between the magazine 21*a* and the image recording section 32 is made less than the maximum length of the paper sheet P. Thereafter, the paper sheet P is conveyed back to the magazine side, and then conveyed again through the registering section to the image recording section 32.

Figure 6A:
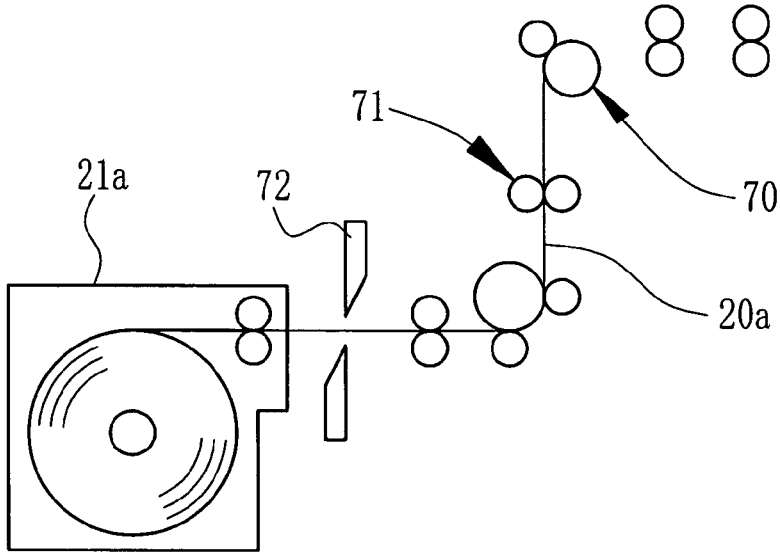
FIGS. 6A, 6B and 6C are explanatory views schematically illustrating a method of shortening the paper feed path between a magazine and an image recording section.
Figure 6B:
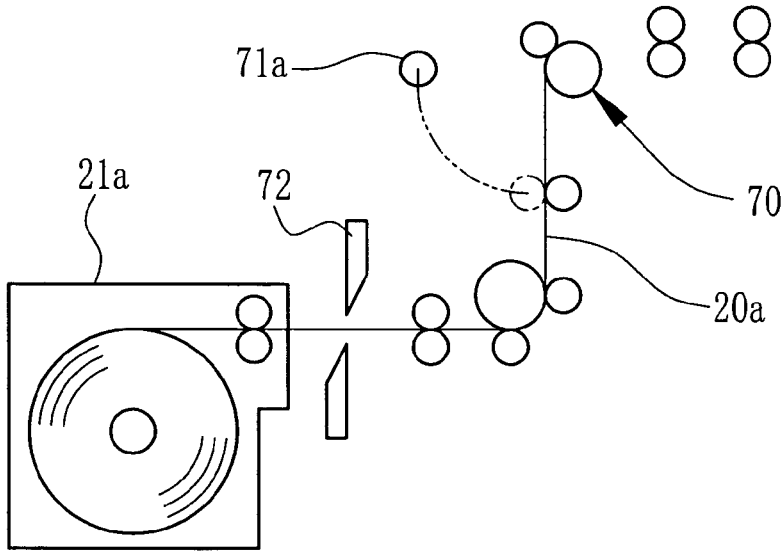
Figure 6C:
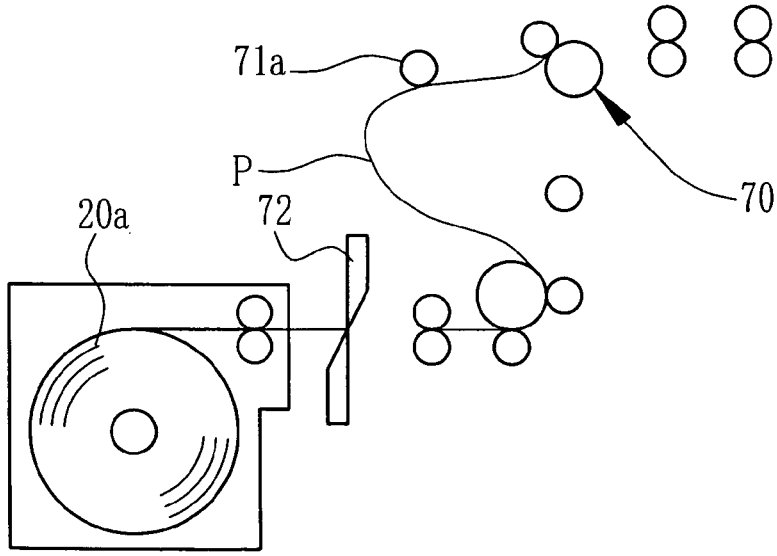

Alternatively, as shown in FIG. 6A, it is possible to bring the photosensitive recording paper 20*a* into contact with a pair of conveyer rollers 70 in the nipping position, while moving a roller 71*a* of another conveyer roller pair 71 to a position shown in FIG. 6B, so as to loop the photosensitive recording paper 20*a* between the conveyer roller pair 70 and a cutter 72. This way, the maximum length of the paper sheet P usable for the printer-processor 2 is kept unchanged while minimizing the distance between the magazine 21*a* and the image recording section 32. The method shown in FIGS. 6A to 6*c* is equivalent to the above mentioned top-registering method in respect that the recording paper is brought into contact with a conveyer roller pair in the nipping position to make a loop of the paper. Therefore, this method is effective not only to shorten the distance between the magazine 21*a* and the image recording section 32, but also to correct skews.

It is also possible to convey a number of paper sheets P in parallel to each other after the paper sheets P have individual images recorded thereon in the image recording section 32, for the sake of improving the processing capacity of the apparatus.

Although the present invention has been described with respect to the cases where the image recording apparatus is the digital printer-processor that exposes the recording paper to the light beams modulated on the basis of digital image data, the present invention is not to be limited to this embodiment. For example, the present invention is applicable to a printer-processor where the paper is exposed to an optical image formed directly from light beams traveling through photographic film. The present invention is also applicable to any types of image recording apparatus, including a thermal printer, a thermal transfer printer and an ink-jet printer.

Thus, the present invention is not to be limited to the embodiments described above but, on the contrary, various modifications will be possible without departing from the scope and spirit of claims appended hereto.

What is claimed is:

1. An image recording apparatus that supplies a sheet of recording material of a predetermined length from a supply section and conveys said recording material along a feed path from said supply section through an image recording section to an ejecting section, to record an image on said recording material in said image recording section, said image recording apparatus comprising:

a feedback path for feeding said recording material from a section of said feed path, between said image recording section and said ejecting section, back to a section of said feed path between said supply section and said image recording section;

a first guide member disposed between said image recording section and said ejecting section, said first guide member being switched over between a first position, for guiding said recording material from said image recording section to said ejecting section, and a second position for guiding said recording material from a side of said ejecting section, to said feedback path;

a controller that switches said first guide member to said second position after said recording material goes past said first guide member in its first position, and then conveys said recording material in opposite direction to feed said recording material into said feedback path, thereby to feed said recording material in reversed position again through said image recording section, for recording images on both sides of said recording material; and a buffer section, branched from said feed path between said first guide member and said ejecting section, for holding said recording material temporarily, and a second guide member switched over between a first position for guiding said recording material from said first guide member toward said ejecting section and a second position for guiding said recording material from said first guide member toward said buffer section, wherein said controller feeds said recording material through said second guide member in its second position into said buffer section with one end of said recording material ahead, and after an opposite end of said recording material goes past said first guide member in its first position, said controller switches over said first guide member to its second position, and then conveys said recording material in opposite direction to feed said recording material into said feedback path.

2. An image recording apparatus as claimed in claim 1, wherein said supply section comprises at least a magazine containing a roll of continuous web of recording material, and a cutter for cutting the continuous web of recording material into the predetermined length at an exit of said magazine, and wherein said feedback path feeds said recording material back to said feed path between said cutter and said image recording section.

3. An image recording apparatus as claimed in claim 1, further comprising a skew correcting section, between said supply section and said image recording section, for correcting skew of said recording material, wherein said feedback path feeds said recording material back to said feed path between said supply section and said skew correcting section.

4. An image recording apparatus as claimed in claim 1, further comprising a skew correcting section for correcting skew of said recording material between said supply section and said image recording section, wherein said supply section comprises at least a magazine containing a roll of continuous web of recording material, and a cutter for cutting the continuous web of recording material into the predetermined length at an exit of said magazine, and wherein said feedback path feeds said recording material back to said feed path between said cutter and said skew correcting section.

5. An image recording apparatus as claimed in claim 1, further comprising a backside imprint section between said first and second guide members, wherein, when one-side printing is designated, said backside imprint section imprints information on a back side of said recording material after said recording material has an image recorded on another side and goes past said first guide member in its first position, and said controller feeds said recording material, after having information imprinted on the back side, toward said ejecting section through said second guide member in its first position.

6. An image recording apparatus as claimed in claim 1, wherein said controller feeds a second sheet of recording material to said image recording section for recording a different image on said next sheet while a first sheet of recording material is being fed to a section of said feed path behind said first guide member, or to said feedback path for the sake of both-side printing.

7. An image recording apparatus as claimed in claim 1, wherein said recording material is a photosensitive material on which an image is recorded by exposure, and wherein said image recording apparatus is provided with a photographic processing section between said second guide member and said ejecting section, and said recording material having an image recorded in said image recording section is subjected to photographic processing while being conveyed through said photographic processing section, and then ejected from said ejecting section.

8. An image recording apparatus as claimed in claim 5, wherein when the one-side printing is designated and if the length of said recording material along said feed path is greater than a distance between said image recording section and said backside imprint section, said controller switches said second guide member to its second position to feed said recording material into said buffer section without making the backside imprinting till a trailing end of said recording material comes to said backside imprint section and, thereafter, conveys said recording material in the opposite direction while driving said backside imprint section to make the backside imprinting, and when the backside imprinting is finished, said controller switches said second guide member to its first position to convey said recording material toward said ejecting section.

* * * * *